US011906234B2

(12) United States Patent
Menzer et al.

(10) Patent No.: US 11,906,234 B2
(45) Date of Patent: Feb. 20, 2024

(54) VENTILATION UNIT FOR A FREEZER CHAMBER

(71) Applicant: Binder GmbH, Tuttlingen (DE)

(72) Inventors: Rolf Menzer, Orsingen-Nenzingen (DE); Hartmut Winkler, Tuttlingen (DE); Richard Leidolt, Singen (DE)

(73) Assignee: Binder GmbH, Tuttlingen (DE)

( * ) Notice: Subject to any disclaimer, the term of this patent is extended or adjusted under 35 U.S.C. 154(b) by 81 days.

(21) Appl. No.: 17/484,669

(22) Filed: Sep. 24, 2021

(65) Prior Publication Data

US 2022/0099353 A1 Mar. 31, 2022

(30) Foreign Application Priority Data

Sep. 25, 2020 (DE) ..... 10 2020 125 126.2

(51) Int. Cl.
*F25D 21/04* (2006.01)
*F25D 17/04* (2006.01)

(52) U.S. Cl.
CPC ..... *F25D 21/04* (2013.01); *F25D 17/047* (2013.01); *F25D 2201/1262* (2013.01); *F25D 2400/02* (2013.01); *F25D 2700/02* (2013.01)

(58) Field of Classification Search
CPC ..... F25D 21/04; F25D 17/047; F25D 2201/1262; F25D 2400/02; F25D 2700/02; F25D 21/002; F25D 21/08; F25D 17/045; F25D 11/00; F25D 23/02; F25D 23/028; F25D 23/12; F25D 29/00; F25D 2600/02
See application file for complete search history.

(56) References Cited

U.S. PATENT DOCUMENTS

| | | | | |
|---|---|---|---|---|
| 3,680,329 | A | 8/1972 | Burtis | |
| 3,850,598 | A | 11/1974 | Boehm | |
| 4,257,445 | A | 3/1981 | Cook et al. | |
| 4,569,208 | A | 2/1986 | Villa | |
| 4,662,270 | A | 5/1987 | Fiddler et al. | |
| 6,223,817 | B1 | 5/2001 | Oden et al. | |
| 6,374,620 | B1 * | 4/2002 | Markey | F25D 17/047 62/410 |
| 6,397,620 | B1 | 6/2002 | Kelly et al. | |
| 6,427,772 | B1 | 8/2002 | Oden et al. | |

(Continued)

FOREIGN PATENT DOCUMENTS

| | | |
|---|---|---|
| CN | 2831003 | 10/2006 |
| CN | 107270616 | 10/2017 |

(Continued)

OTHER PUBLICATIONS

European Patent Office, "European Search Report" issued in European Patent Application No. 21194110.9, dated Feb. 17, 2022; document of 11 pages.

(Continued)

*Primary Examiner* — Brian M King
*Assistant Examiner* — Ibrahim A. Michael Adeniji
(74) *Attorney, Agent, or Firm* — Akerman LLP; Peter A. Chiabotti

(57) ABSTRACT

A ventilation unit for a freezer chamber, with a conduit and at least one heating element, wherein in the conduit, at least in sections, an air-permeable filler material is disposed, as well as a freezer chamber with such a ventilation unit as well as methods for operating such ventilation unit.

11 Claims, 5 Drawing Sheets

(56) References Cited

U.S. PATENT DOCUMENTS

| | | | | |
|---|---|---|---|---|
| 2005/0160754 | A1* | 7/2005 | Hugh | F25D 17/047 62/275 |
| 2007/0107458 | A1 | 5/2007 | Kim | |
| 2016/0327328 | A1 | 11/2016 | Jeong | |

FOREIGN PATENT DOCUMENTS

| | | |
|---|---|---|
| CN | 110806050 | 2/2020 |
| DE | 202014008327 | 3/2016 |
| DE | 202014008327 U1 | 3/2016 |
| EP | 0695110 | 1/1996 |

OTHER PUBLICATIONS

Office Action dated Jan. 20, 2023, in Chinese patent application No. 2021111139855, with English translation.

* cited by examiner

VENTILATION UNIT FOR A FREEZER CHAMBER

CROSS-REFERENCE TO RELATED APPLICATIONS

This application claims priority to German Patent Application No. 10 2020 125 126.2, filed Sep. 25, 2020, which is incorporated by reference in its entirety

BACKGROUND

The patent application relates to a ventilation unit for a freezer chamber.

SUMMARY

The phenomenon entailed in freezer chambers of diverse types is that, after closing a door disposed on the freezer chamber, the same can initially not be opened or only opened again when expending a large force. This phenomenon can be traced back to the temperature dependency of the density of air. For instance, with decreasing temperature the density of the air increases and the specific volume of air decreases accordingly.

If, while the door is open, an exchange of air takes place between the interior volume of the freezer chamber and the work environment, then, after the door is subsequently closed, the warmer ambient air in the interior volume of the freezer chamber is cooled down. The specific volume of the air within the interior volume of the freezer chamber thereby decreases. As a consequence, a pressure differential is generated between the freezer chamber interior volume and the work environment. Until there is equilibrium of the pressure differential, the door can only be opened with difficulty or even not at all. This complex problem is especially relevant in the case of freezer chambers, especially in ultra low freezer chambers whose interior volume is cooled down up to −90° C., since in this case, due to the large temperature differences with respect to the work environment, considerable pressure differentials may occur.

Various ventilation systems are known within prior art to reach pressure equilibrium between the interior volume and the work environment after the door is closed. For example, U.S. Pat. Nos. 4,662,270, 3,680,329, US 2007/0 107 458 A1 as well as US 2016/0 327 328 A1 introduce systems that comprise heated piping which connects the interior volume with the work environment. US 2005/0 160 754 A1 as well as US 2007/0 107 458 A1 additionally provide a timer for the control of the heating. All of these systems comprise differently implemented valves for the separation of the interior volume and the work environment at equilibrated pressure conditions. DE 20 2014 008 327 U1, U.S. Pat. No. 4,257,445 as well as U.S. Pat. No. 4,569,208 show examples of the manner in which such valves can be implemented.

Of disadvantage in the ventilation systems disclosed in prior art is that they comprise valves having moving parts or components. This leads to wear and tear which decreases the service life of the systems and generates maintenance expenditures. Such systems, moreover, are complex and costly of production.

The present application therefore addresses the problem of providing a ventilation system for freezer chambers with high service life as well as low maintenance expenditures and which is, furthermore, preferably simple of production. In addition, present application addresses the problem of providing a freezer chamber with a corresponding ventilation system as well as a method for actuating such a ventilation system in a freezer chamber.

The problem is resolved through a ventilation until for a freezer chamber, a freezer chamber and method having the features and structures recited herein.

The ventilation unit according to the disclosure for a freezer chamber comprises a conduit and at least one heating element, wherein in the conduit, at least in sections, an air-permeable filler material is disposed.

The specified normal use of the ventilation unit lies preferably in equalizing pressure differentials between two gas-filled, in particular air-filled, volumes. For this purpose, air can flow through the conduit when the ventilation unit is in operation. The conduit has herein preferably a direction of throughflow.

When deploying the ventilation unit in a freezer chamber, the conduit and the filler material disposed therein can ice over due to the temperatures obtaining in the freezer chamber. Icing over occurs in particular thereby that water condenses out of the air and freezes. Icing over can lead to a decrease of the conduit cross section or even block it completely. An ice plug is therewith preferably disposed in the conduit to close it off completely. An air stream through the ventilation unit can therewith be decreased or be blocked off completely. According to the present disclosure, this effect can be intentionally exploited, in particular for the prevention of undesirable air streams through the ventilation unit at equilibrated pressure conditions and can be enhanced through the disposition of the filler material in the conduit. By activating the heating element, de-icing, thus opening, or keeping-clear-of-ice, thus keeping-open, of the ventilation unit can be accomplished.

The conduit can be implemented straight or it can comprise at least a curvature. The conduit is preferably fabricated of a material, in particular of a metal material, having high thermal conductivity. Due to the high thermal conductivity, in particular rapid de-icing of the ventilation unit can be enabled. The conduit can, in particular, have a round, a square or a polygonal cross section. In particular a square or polygonal cross section can be distinguished through especially low production costs.

The heating element can be developed as an electric heating element. The heating element can, alternatively, also be developed as a fluidic heating element in which fluid substances such as, for example, cooling fluid, water or oil or gaseous substances, such as, for example, air are deployed as the medium for the heat transport.

The filler material is preferably disposed in the conduit such that it completely fills the cross section of the conduit. The filler material preferably has good thermal conductivity properties. Therefore, suitable as filler materials are in particular metal materials. In this manner, rapid introduction of heat into the filler material and rapid dissipation of heat out of the filler material can be achieved. The air permeability of the filler material is preferably attained thereby that it comprises cell-like channels throughout which air, streaming through the conduit, can flow. On the filler material water from the air can condense. The cell size is herein preferably selected to be of small enough size for the condensation water to be able to close them off by freezing. The cell size is simultaneously preferably selected to be of large enough size so that with the cells open, thus not frozen closed, a sufficiently large air throughput through the filler material is feasible. The thawing, and therewith the opening of the cells, can take place by activation of the at least one heating element. Advantageous can, in particular, be filler materials that have a fine cell structure with a multiplicity of small cells. Due to the multiplicity of the cells a high air throughput can be enabled. Simultaneously, such filler material can have a large surface area on which water can condense. Through a fine cell structure, moreover, rapid thawing can be enabled.

The at least one heating element is preferably disposed on the conduit. The at least one heating element can herein be disposed on the inside and/or on the outside of the conduit. The at least one heating element is preferably disposed in the circumferential direction about the conduit on the outside of the conduit. With the activation of the at least one heating element the conduit can therewith be heated from the outside. The heat can be introduced across the conduit into the filler material. The at least one heating element is especially preferably disposed in that section of the conduit in which the filler material is disposed. The path of thermal conduction from the at least one heating element to the filler material can be kept short in this manner. The time delay between the activation of the at least one heating element and the heating of the filler material can thereby be kept low. In this way dynamic heating of the filler material can be realized. The time delay between the activation of the at least one heating element and the opening of the cells can thereby also be minimized.

The filler material is preferably developed as a knit wire mesh. By knit wire mesh is herein to be understood any three-dimensional structure formed of wire in which interspaces are disposed between the individual wires or wire strands. The interspaces herein are denoted as cells. At the same time, the structure can be organized, for example, in the form of a web, net or knit in the literal sense or be nonorganized in the form of an entanglement. The knit wire mesh can also be developed as a mixed form of organized and nonorganized structure. The knit wire mesh can be developed to be elastic. It can, in particular, be developed as a spongy formation. The elasticity of the knit wire mesh can be regulated, in particular, through the size of the cells and the thickness of the utilized wire. Knit wire meshing of wire of reduced thickness can be advantageous in particular for deployment in a ventilation unit since therewith a very fine cell structure can be created.

The filler material can alternatively be formed using bulk material of elements such as for example chippings, shavings, turnings or spheres. The cells can herein be formed by the interspaces disposed between the individual elements. The cell size is herein preferably regulatable through the size of the elements. The filler material can, alternatively, be formed by any open-cell structure. Suitable for this purpose are in particular foams, preferably metal foams.

The heating element in a further development of the present disclosure is formed by the filler material. The heating element is herein preferably developed as an electric heating element. The filler material can be developed as an electric resistor. By activating the heating element the filler material can therewith function as a heat source. The heat can thereby be generated directly in the filler material where it is required for unfreezing the cells. Energy losses generated in the heat conduction can therewith be avoided and the number of structural parts of the ventilation unit can be reduced. The heating element can alternatively, at least in sections, be formed by the conduit. For this purpose, the conduit can, at least in sections, be developed as an electric resistor.

In an advantageous embodiment of the present disclosure the conduit comprises at least one securement element for securing the filler material. With the aid of the securement element displacement, caused in particular by air streams in the conduit, of the filler material can be avoided. The securement element preferably establishes a connection with the filler material under form and/or friction closure. The securement element itself can herein be connected with the conduit under material, form and/or friction closure. Especially preferred is the disposition of the securement element downstream of the filler material in the direction of throughflow.

The securement element is preferably developed as a pin or a tongue. The pin or the tongue is preferably disposed transversely to the longitudinal conduit axis. The pin can, in particular, be disposed in a bore extending transversely to the longitudinal conduit axis. The tongue is preferably developed thereby that a contour of the tongue is cut, at least in a section, out of a wall of the conduit such that the contour has a cut-out section. The tongue is bent at a non-cut-out section of the contour into the cross section of the conduit. The non-cut-out section is herein preferably developed such that it is perforated in order to facilitate the inward bending. The cutting-out can be carried out in particular by lasering or die cutting. The securement element can be produced especially cost-effectively due to the development as a tongue.

The securement element can alternatively be developed, for example, as a grid. The filler material can further be secured thereby that the cross section of the conduit is, at least in sections, reduced in particular downstream of the filler material in the direction of flow.

The cross section reduction, at least in sections, of the conduit can be attained, for example, with the aid of a securement ring which is preferably disposed in the conduit. For this purpose, the conduit can comprise a securement groove.

A freezer chamber according to the present application comprises a housing comprising an interior volume, at least one door as well as a ventilation unit according to the disclosure. The freezer chamber can in particular be an ultra low freezer chamber. Ultra low freezer chambers preferably have a control range of −90° C. to −40° C. As interior volume is denoted in particular that volume which, when the door is closed, is enclosed by the housing and the door.

The at least one ventilation unit is preferably disposed in the at least one door and/or in the housing such that a first end of the conduit opens out into the interior volume and a second end of the conduit opens out into a work environment. By work environment is preferably denoted that volume that is disposed outside of the freezer chamber. The temperature in the interior volume is conventionally below the temperature in the work environment. The conduit can be iced over and thus be blocked by an ice plug. The ice plug is, for example, formed by water that has condensed on the filler material. The work environment and the interior volume consequently can be separated through the housing and the at least one door of the freezer chamber.

In particular when the interior volume is separated from the work environment, a pressure differential between interior volume and work environment can occur. This is typically the case when, for example, the door is temporarily opened and warm air from the work environment reaches the interior volume. The air is conventionally cooled here whereby its volume decreases and the pressure in the interior volume decreases in comparison to the work environment. Therewith there is typically a correlation between the opening of the door and the development of a pressure differential. A pressure differential can be equalized thereby that air can flow from the work environment into the interior volume.

Thereby that the conduit opens out with its first end into the interior volume and with its second end opens out into the work environment, the ventilation unit can establish a connection between interior volume and work environment. The connection is preferably established thereby that the at least one heating element is activated and consequently the ice plug thaws out and the ventilation unit is opened. Thereby air can flow into the interior volume.

Based on the typical pressure gradient, a direction of throughflow of the conduit from the work environment to the interior volume results. The blocking of the conduit preferably takes place by deactivating the at least one heating element. Consequently, in particular the conduit and the filler material of the ventilation unit can be cooled due to the low temperatures obtaining in the interior volume. On the conduit and the filler material therewith water can condense out of the air, in particular out of the air in the conduit, and form a new ice plug.

In a preferred embodiment of the present disclosure the heating element is activatable by the opening of the at least one door. The freezer chamber can in particular comprise an opening sensor, for example in the form of a switch or a sensing device, that can detect the opening of the door.

The disclosure is preferably developed such that the heating element is deactivatable after passage of a specific time interval after the closing of the at least one door. Due to the deactivation of the at least one heating element, icing over, and thus a blocking, of the ventilation unit can be enabled. The time interval is preferably to be selected such that the pressure differential, caused by the opening and closing of the door, between the work environment and the interior volume is equalized after the door is closed. Through the time interval can in particular be taken into consideration the factor that the pressure differential after the closing of the door does not immediately manifest itself at its maximal extent but rather shows progression over time. The progression over time herein depends inter alia on the length of time the door had been open, the volume of the interior volume, the magnitude of the air volume exchanged at opened door between interior volume and work environment and the magnitude of the temperature difference between the interior volume and work environment. Freezer chamber-dependent factors can be, for example, the volume of the interior volume, the capacity of the freezer chamber as well as its cooled mass. In particular, if the time elapsed since the last opening of the door has not been long enough, an effect of the last door opening onto the time progression of the pressure differential can be present.

The freezer chamber can be developed such that the time interval can be defined by pre-setting. A value of three minutes has been found to be especially advantageous. The time interval can preferably be set by a user of the freezer chamber. The time interval can further be determined or affected by drawing on data entered by the user and/or by including data determined by means of sensors. Such data can be, for example, the interior volume temperature, the work environment temperature, the pressure differential and/or the temperature difference between interior volume and work environment.

In a method according to the present application for operating a ventilation unit in a freezer chamber according to the disclosure the opening of the at least one door is detected, the heating element is activated with the door open, the closing of the at least one door is detected and the heating element is deactivated after the specified time interval after the door had been closed has elapsed.

The at least one heating element is preferably activated simultaneously with the detection of the opening of the door. By the activation of the at least one heating element with the opening of the door can be achieved that the ventilation unit is opened with a subsequent closing of the door, such that pressure equalization between work environment and interior volume can take place. In particular the factor can therewith be taken into account that typically there exists a correlation between the opening of the door and the occurrence of a pressure differential between interior volume and work environment.

In a further development of the disclosure the temperature difference and/or the pressure differential between interior volume and work environment are drawn on in determining the time interval. For this purpose, preferably the pressure differential and/or the temperature difference between interior volume and work environment are monitored. Large pressure differentials and/or temperature differences preferably extend the length of the time interval. At low pressure differential and/or temperature difference the method can be modified such that the time interval is shortened accordingly.

In the determination of the time interval can be included an interval time elapsed since the last deactivation of the heating element and/or the heating duration between the last activation and deactivation of the heating element. The heating of the ventilation unit during the time interval preferably serves for keeping the ventilation unit sufficiently long open, thus free of ice, after the closing of the door in order to enable pressure equalization. If the last activity of the heating element occurred adequately recently, residual heat can still be present in the ventilation element unit which can support holding open the ventilation unit. There is conventionally more residual heat available the more recent the last activity of the heating element occurred. The operation of the ventilation unit can therefore be developed such that a short interval time enables the shortening of the time interval. The duration of the last activity of the heating element, the last heating duration, can also provide an indication of how much residual heat is available in the ventilation unit. The method is therefore preferably developed such that the last heating duration, thus the duration of the last activity of the heating element, exerts a shortening effect onto the time interval.

BRIEF DESCRIPTION OF DRAWINGS

Embodiment examples of the present application will be explained in conjunction with the following Figures. Therein depict.

DETAILED DESCRIPTION

For same and functionally same parts same reference numbers are used. For the sake of clarity not all reference numbers are used in every Figure.

Figure 1:
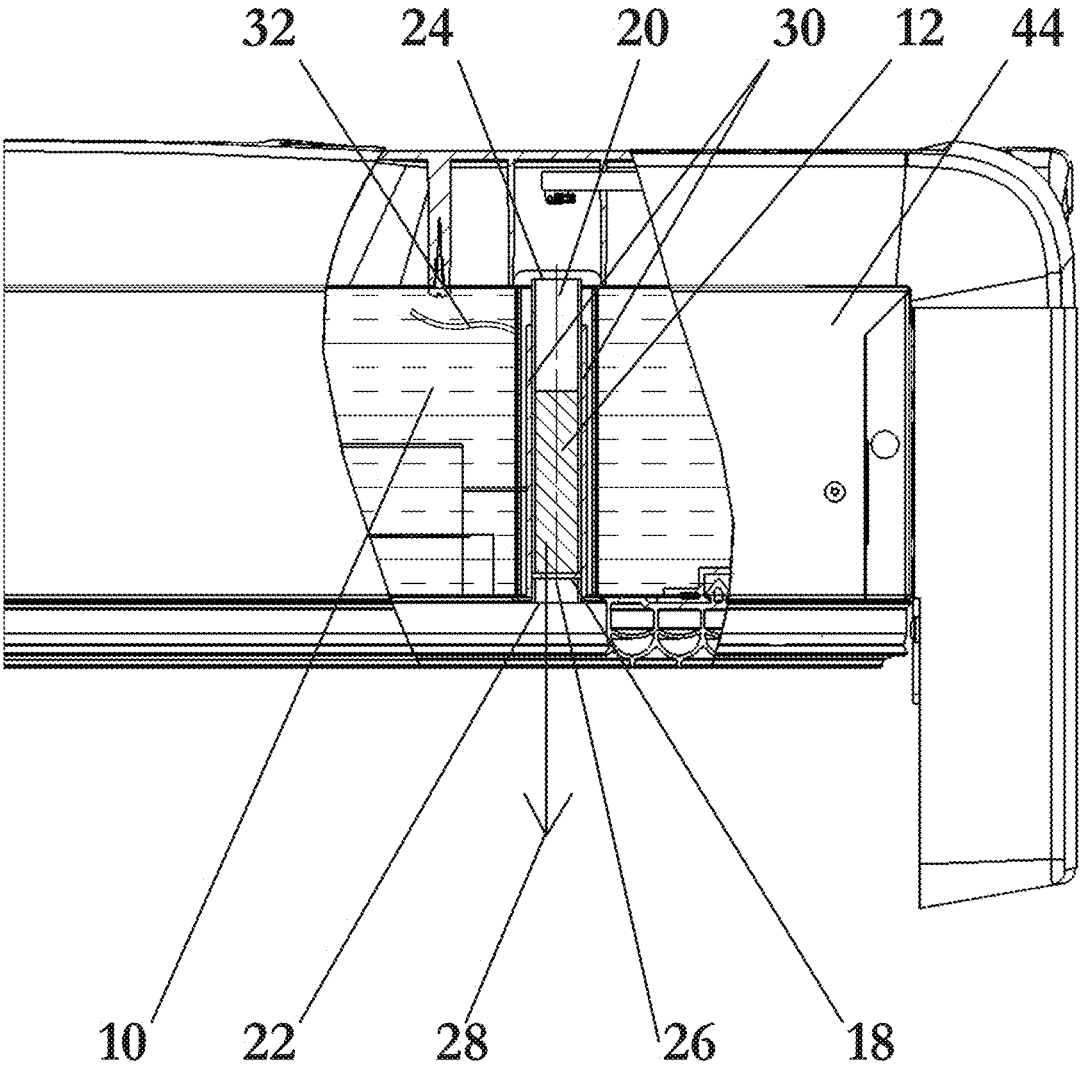
FIG. 1 a schematic representation of an embodiment example of a ventilation unit disposed in a door, FIG. 2 a schematic representation of an embodiment example of a conduit, FIG. 3 a schematic representation of a further embodiment example of a conduit, FIG. 4 a schematic representation of an embodiment example of an ultra low freezer chamber with a ventilation unit, FIG. 5 a flowchart of a first method for operating a ventilation unit in an ultra low freezer chamber, FIG. 6 a flowchart of a second method for operating a ventilation unit in an ultra low freezer chamber.

FIG. 1 shows a ventilation unit or device 10 disposed in a door 44, with a conduit 20 and a heating element 30. In the conduit 20 is disposed an air-permeable filler material which can be developed as a knit wire mesh 12.

Figure 2:
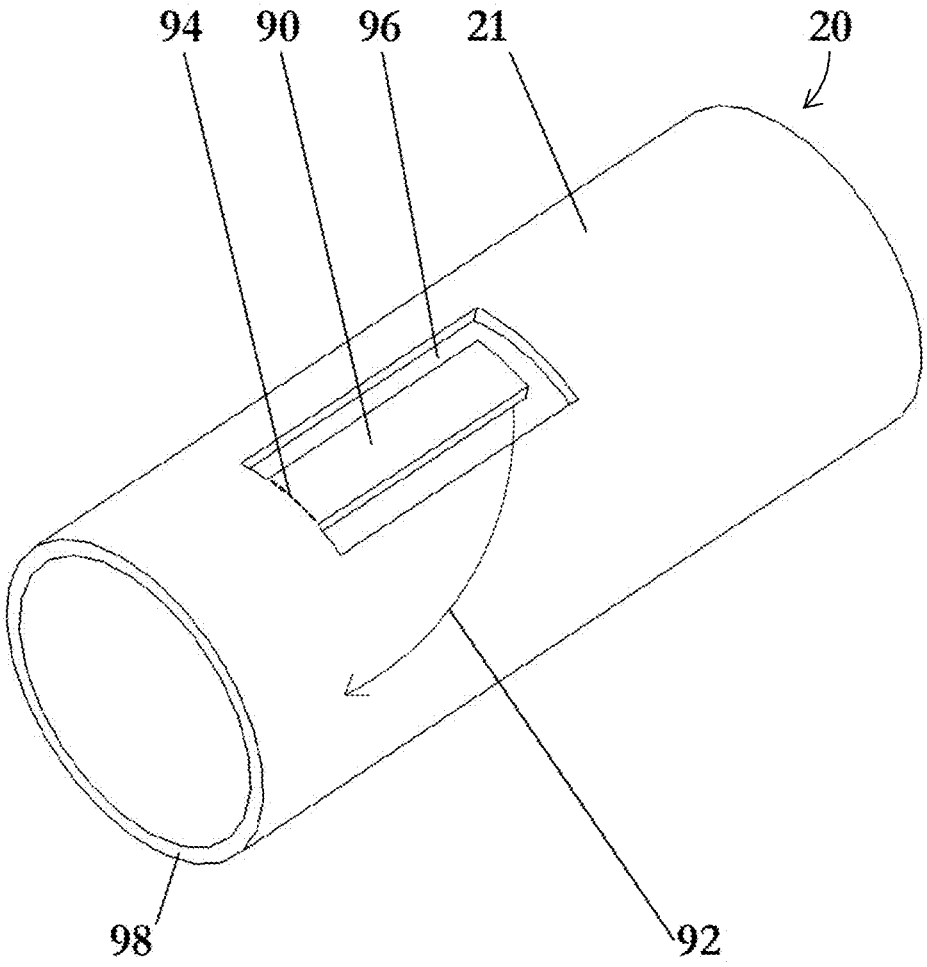
Figure 3:
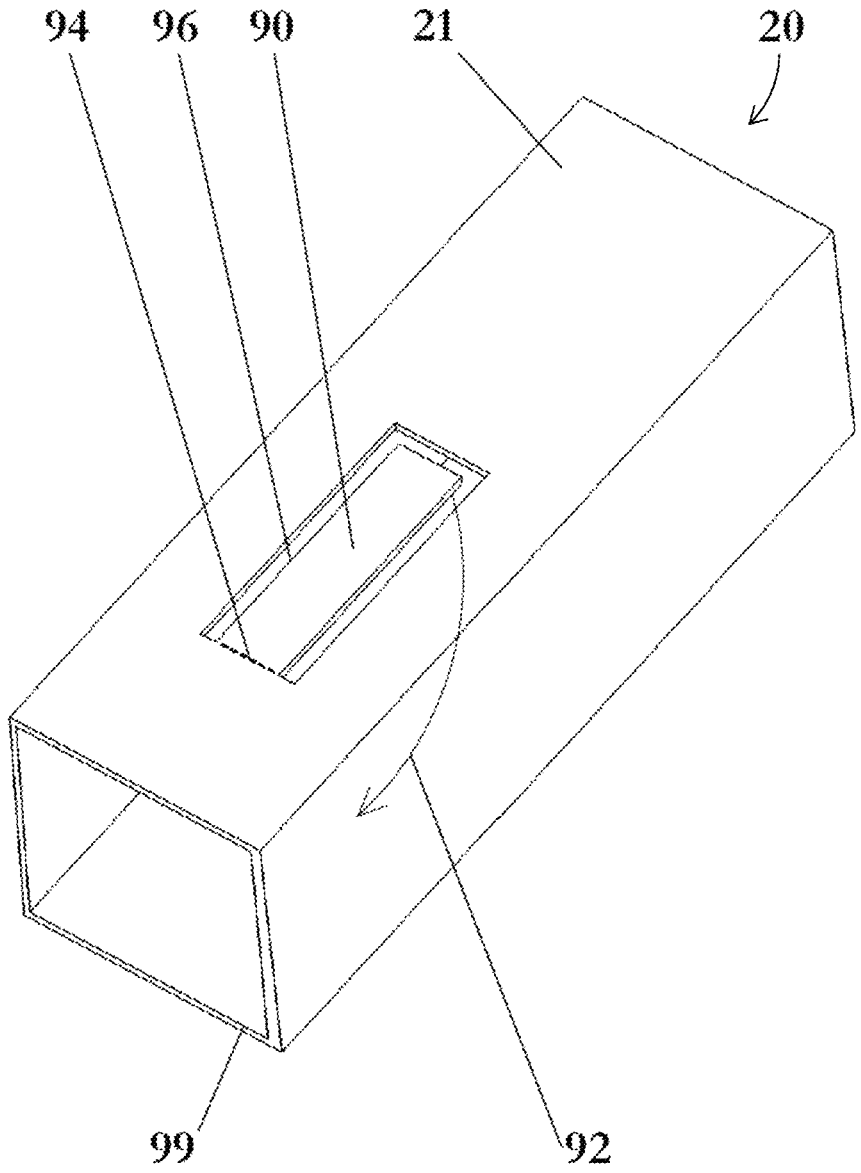

The specified normal operation of the ventilation unit 10 preferably lies in equalizing a pressure differential 82 (s. FIG. 3) between two volumes, in particular between an interior volume 46 and a work environment 50 (s. FIG. 2). For this purpose, through the conduit 20 there can be an air can flow. For this purpose the conduit 20 preferably has a direction of throughflow 28.

Figure 4:
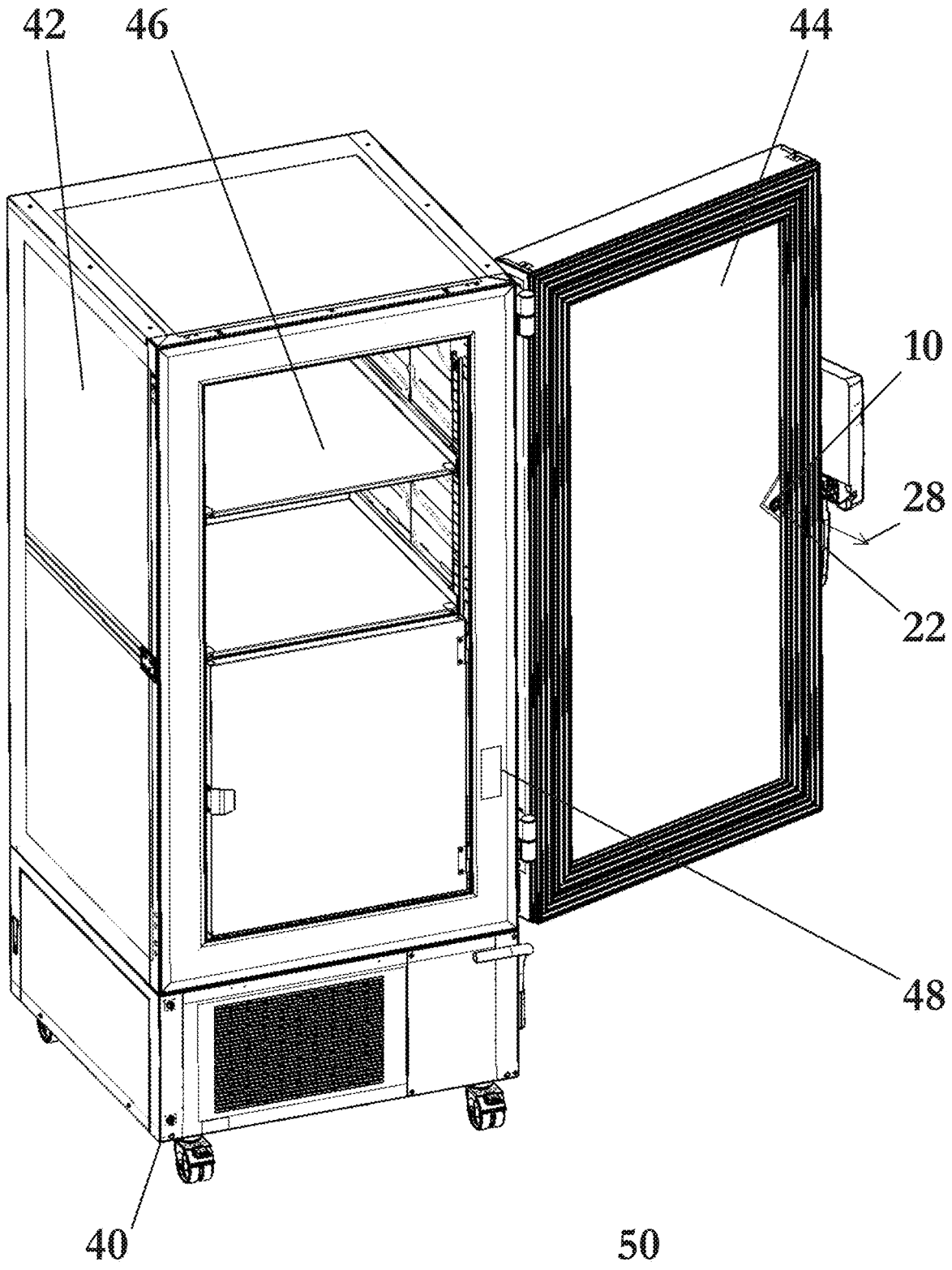

FIG. 4 shows a freezer chamber developed as an ultra low freezer chamber 40 with a ventilation unit 10. When the ventilation unit 10 is deployed in the ultra low freezer chamber 40, the conduit 20 and the knit wire mesh 12 disposed therein can ice over under the temperatures obtaining in the ultra low freezer chamber 40. The icing over takes place, for example, thereby that water condenses out of the air and freezes. Due to the icing over the cross section of the conduit 20 can decrease or can even become completely blocked. For the complete blocking of the conduit 20 thus preferably an ice plug is disposed in the conduit 20. An air stream through the ventilation unit 10 can therewith be decreased or be completely disrupted. This effect can be intentional, in particular, for the purpose of preventing undesirable air flows through the ventilation unit 10 and be enhanced through the disposition of the knit wire mesh 12 in the conduit 20. By activating the heating element 30 the de-icing, thus opening, or, as the case may be, the maintaining of the ventilation unit 10 ice-free, thus keeping it open, can be achieved.

FIG. 1 shows further details of the ventilation unit 10. The conduit 20 thus preferably comprises a first end 22, a second end 24 as well as a longitudinal conduit axis 26. The conduit 20 can be developed straight or comprise at least one curvature. The conduit 20 is preferably fabricated of a material, in particular of a metal material, having high thermal conductivity. Due to the high thermal conductivity in particular rapid de-icing of the ventilation unit 10 can be enabled. The conduit 20 can, for example, have a round cross section 98 (FIG. 2) or a square cross section 99 (FIG. 3).

The knit wire mesh 12 is preferably disposed in the conduit 20 such that it completely fills the cross section of conduit 20. The knit wire mesh 12 is herein preferably a three-dimensional wire structure in which are disposed interspaces between the individual wires or wire strands. On the wires or wire strands as well as on the conduit 20 water can condense out of the air. The interspaces are denoted as cells and can ensure the air permeability of the knit wire mesh 12. The size of the cells herein is preferably selected to be small enough for the cells to freeze up through the water that is condensed on the knit wire mesh 12. The size of the cells is preferably simultaneously selected such that when the cells are open, thus not frozen up, a sufficiently large air through-put through the knit wire mesh 12 is enabled.

The knit wire mesh 12 can be developed such that it is elastic. It can, in particular, be developed as a spongy formation. The elasticity of the knit wire mesh 12 can, in particular, be regulated by the size of the cells and the thickness of the utilized wire strands. A knit wire mesh 12 of wire strands with reduced thickness can be especially advantageous for deployment in a ventilation unit 10 since therewith a very fine cell structure can be created.

The heating element 30 can be developed as an electric heating element. The heating element 30 is herein preferably supplied with energy across a cable 32. The heating element 30 is preferably disposed on the outside of conduit 20 in the circumferential direction about the conduit 20. With the activation of the heating element 30 the conduit 20 can therewith be heated from the outside. The heat can be introduced across conduit 20 into the knit wire mesh 12. The heating element 30 is herein preferably disposed in that section of the conduit 20 in which the knit wire mesh 12 is disposed. In this way the conduction path of heat from heating element 30 to the knit wire mesh 12 can thereby be kept short. The time delay between the activation of the heating element 30 and the heating of the knit wire mesh 12 can thereby be kept low. In this manner, dynamic heating of the knit wire mesh 12 can be realized. Therewith the time delay between the activation of the at least one heating element 30 and the opening of the cells can also be minimized.

The conduit 20 preferably comprises a securement element in the form of a pin 18 for securing the knit wire mesh 12. With the aid of the pin 18 displacement, caused in particular by air flows in the conduit 20, of the knit wire mesh 12 can be avoided. For this purpose, pin 18 is preferably disposed downstream of the knit wire mesh 12 in the throughflow direction 28. Pin 18 can establish a connection under form closure between the knit wire mesh 12 and the conduit 20. The pin 18 is for this purpose preferably disposed transversely to the longitudinal conduit axis 26 and disposed in a bore extending transversely to the longitudinal conduit axis 26.

FIG. 2 and FIG. 3 show embodiment examples of a conduit 20 in which the securement is formed by a tongue 90. The tongue 90 is preferably formed thereby that a contour of tongue 90 is, at least in sections, cut out of a wall 21 of conduit 20 such that the contour comprises a cut-out section 96. Tongue 90 can be bent at a non-cut-out section 94 of the contour in the direction of bending 92 into the cross section of conduit 20. The non-cut-out section 94 is herein preferably developed such that it is perforated in order to facilitate the inward bending. The cutting can be carried out using, in particular, lasering or die cutting. By the development as a tongue 90 the securement element can be produced especially cost-effectively.

The depiction in FIG. 2 shows the conduit 20 in a fabrication step in which the tongue 90 has already been cut out, however, has not yet been bent into the cross section of conduit 20.

FIG. 3 shows a conduit 20 in which the tongue 90 has been bent into the cross section of conduit 20.

In FIG. 4 further details of the ultra low freezer chamber 40 are depicted. The ultra low freezer chamber 40 preferably has a control range from −90° C. to −40° C. The ultra low freezer chamber comprises a housing 42 in which the interior volume 46 is disposed. The ultra low freezer chamber 40 furthermore comprises a door 44 as well as the ventilation unit 10. As interior volume 46 is, in particular, denoted that volume which, with the door 44 closed, is encompassed by the housing 42 and the door 44.

The ventilation unit 10 is preferably disposed in the door 44 such that, when the door 44 is closed, the first end 22 of conduit 20 empties out into the interior volume 46 and a second end 24 of conduit 20 empties out into the work environment 50. The work environment 50 is preferably formed by that volume which is located outside of the ultra low freezer chamber 40.

The temperature in the interior volume 46 is conventionally below the temperature in the work environment 50. The conduit 20 can be iced over and therewith be blocked by an ice plug. The ice plug is preferably formed by water that has condensed on the knit wire mesh 12. The work environment 50 and the interior volume 46 can consequently be separated through the housing 42 and the door 44 of the ultra low freezer chamber 40.

In particular when the interior volume 46 is separated from the work environment 50 a pressure differential 82 can occur between interior volume 46 and work environment 50. This is typically the case when, due to temporary opening of door 44, warm air from the work environment 50 has penetrated into the interior volume 46. The air is conventionally cooled here whereby its volume decreases and the pressure in the interior volume 46 drops in comparison to the work environment 50. Thus, there is typically a correlation between the opening of the door 44 and the generation of a pressure differential 82. A pressure differential 82 can be equalized thereby that air can flow from the work environment 50 into the interior volume 46.

Thereby that conduit 20 with its first end 22 opens out into the interior volume 46 and with its second end 24 opens out into the work environment 50, the ventilation unit 10 can establish a connection between interior volume 46 and work environment 50. The connection is preferably established thereby that the heating element 30 is activated and therewith the ice plug is thawed and the ventilation unit 10 is opened. Air can thereby flow into the interior volume 46. Based on the typical pressure gradient, preferably a through-flow direction 28 of the conduit 20 from the work environment 50 toward the interior volume 46 results. The blocking of conduit 20 preferably takes place by deactivating the heating element 30. In particular, the conduit 20 and the knit wire mesh 12 of ventilation element unit 10 can consequently be cooled by the low temperatures obtaining in the interior volume 46. Therewith on the conduit 20 and the knit wire mesh 12 water can condense out of the air and forms a new ice plug.

The heating element 30 is preferably activatable through the opening of door 44. The ultra low freezer chamber 40 can comprise an opening sensor 48 that can detect the opening of door 44. The heating element 30 is preferably deactivatable after a specific time interval 66 (s. FIGS. 3 and 4) after the closure of the at least one door 44 has elapsed.

Figure 5:
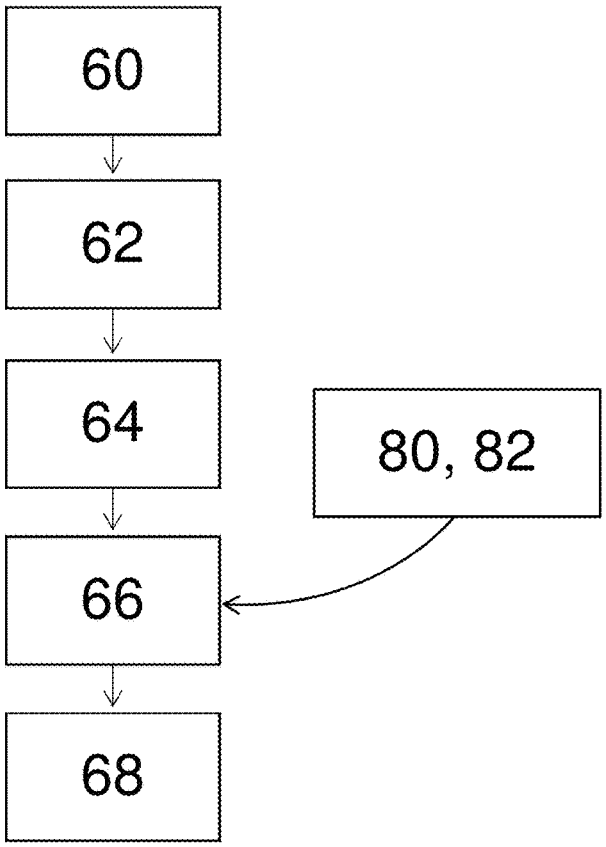

FIG. 5 shows a flowchart of a first method for operating the ventilation unit 10 in the ultra low freezer chamber 40. Due to the detection 60 of the opening of door 44, herein an activation 62 of the heating element 30 takes place. After subsequently again a detection 64 of the closing of door 44 has taken place, a deactivation 68 of heating element 30 is carried out after the specified time interval 66 has elapsed.

The activation 62 of heating element 30 preferably takes place without time delay with the detection 60 of the opening of door 44. It can thereby be achieved that the ventilation device unit 10 is opened at a subsequent closing of door 44 such that pressure equalization between work environment 50 and interior volume 46 can take place. Therewith the factor can be taken into account that typically there exists a correlation between the opening of door 44 and the development of a pressure differential 82 between the interior volume 46 and the work environment 50.

The length of time interval 66 is preferably chosen to be such that the pressure differential 82, generated by the opening and closing of door 44, between work environment 50 and interior volume 46 is equalized after the closing of door 44. With the aid of time interval 66 herein in particular the factor can be taken into account that the pressure differential 82 after the closing of door 44 does not manifest immediately in its full magnitude after the closing of door 44 but rather shows progression over time.

The ultra low freezer chamber 40 can be developed such that the time interval 66 can be defined by presetting. A value of three minutes has herein been found to be especially advantageous. The time interval 66 can further be determined or influenced by drawing on data entered at the operator side and/or on data determined by means of sensors. Such data can be the pressure differential 82 and/or a temperature difference 80 between interior volume 46 and work environment 50. Large pressure differentials 82 and/or temperature differences 80 preferably extend the time interval 66. At low pressure differentials 82 and/or low temperature differences 80 the method can be modified such that the time interval 66 is shortened correspondingly.

Figure 6:
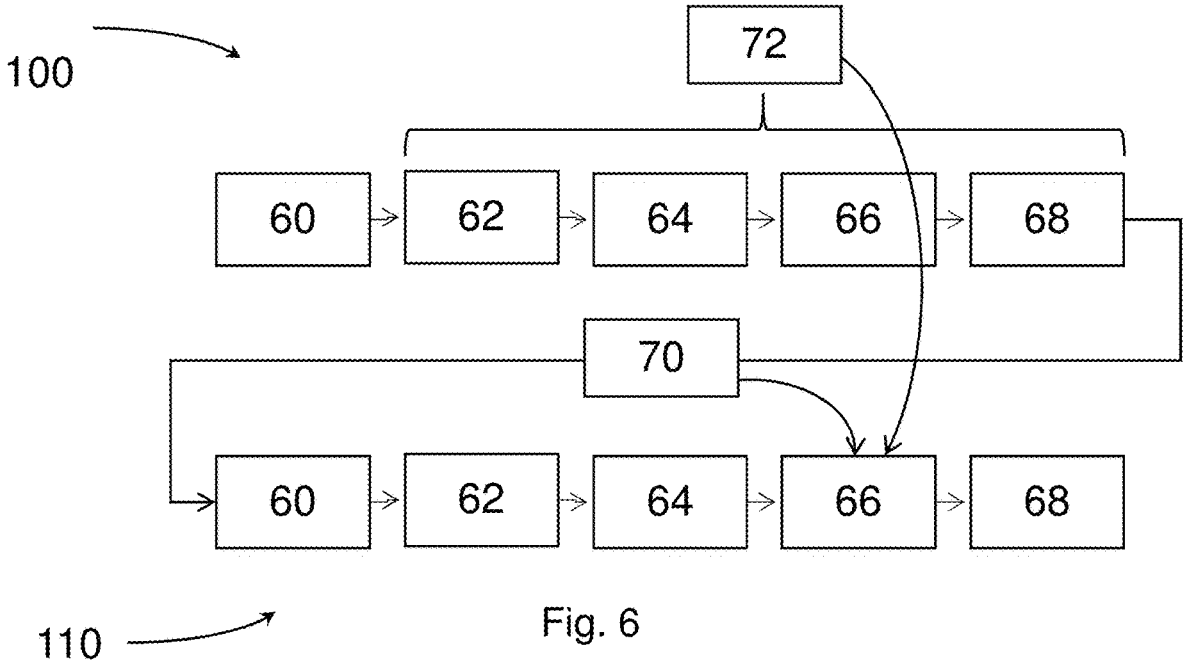

As shown in FIG. 6, in determining the time interval 66 of a current opening cycle 110, reference can be made to a last completed one, thus to a last opening cycle 100. For example, into the determination of the time interval 66 can be incorporated a time interval 70, elapsed since the last deactivation 68 of the heating element 30, and/or a last heating duration 72 between the last activation 62 and deactivation 68 of the heating element 30. Heating of ventilation unit 10 during time interval 66 serves preferably for the purpose of keeping the ventilation unit 10 sufficiently long open, thus free of ice, after the closing of door 44 in order to enable the pressure equalization. If the last activity of the heating element 30 was sufficiently recent, residual heat can still be available in the ventilation unit 10 which can support keeping open the ventilation unit 10. There is usually more residual heat available the more recent the last activity of the heating element 30 occurred, thus the shorter the time interval 70 is. The operation of the ventilation unit 10 can therefore be developed such that a short interval time 70 enables a shortening of the time interval 66 of the current opening cycle 110. The duration of the last activity of heating element 30, the last heating duration 72, can also provide an indication of the magnitude of residual heat that is available in the ventilation unit 10. The method is therefore preferably developed such that a long last heating duration 72 exerts a shortening effect onto the time interval 66.

The method for operating the ventilation unit 10 can, in particular, be developed as a combination of the first method, depicted in FIG. 5, and of the second method, depicted in FIG. 6, such that the temperature difference 80 and/or the pressure differential 82 as well as also the interval time 70 and/or the last heating duration 72 are taken into consideration in determining the time interval 66.

LIST OF REFERENCE NUMBERS

10 Ventilation unit
12 Knit wire mesh
18 Pin
20 Conduit
21 Wall
22 First end
24 Second end
26 Longitudinal conduit axis
28 Through flow direction
30 Heating element
32 Cable
40 Ultra low freezer chamber
42 Housing
44 Door
46 Interior volume

48 Opening sensor
50 Work environment
60 Detection of door opening
62 Activation of heating element
64 Detection of door closing
66 Time interval
68 Deactivation of heating element
70 Interval time
72 Last heating duration
80 Temperature difference
82 Pressure differential
90 Tongue
92 Bending direction
94 Non-cut-out section
96 Cut-out section
98 Round cross section
99 Rectangular cross section
100 Last opening cycle
110 Current opening cycle

What is claimed:

1. A ventilation unit for a freezer chamber, comprising:
a conduit;
a heating element;
an air-permeable filler material disposed in at least sections of the conduit;
wherein the conduit comprises a filler material securement element; and
wherein the securement element is a tongue, the tongue has a contour cut out from a wall of the conduit, and the tongue is bent at a non-cut-out section into a cross section of the conduit.

2. The ventilation unit as in claim 1, wherein the heating element is disposed on the conduit.

3. The ventilation unit as in claim 1, wherein the filler material is a knit wire mesh.

4. The ventilation unit as in claim 1, wherein the heating element is formed by the filler material.

5. A freezer, comprising:
a housing having an interior volume and a door;
a ventilation unit, wherein the ventilation unit comprises:
a conduit;
a heating element;
an air-permeable filler material disposed in at least sections of the conduit;
wherein the conduit comprises a filler material securement element; and
wherein the securement element is a tongue, the tongue has a contour cut out from a wall of the conduit, and the tongue is bent at a non-cut-out section into a cross section of the conduit.

6. The freezer chamber as in claim 5, wherein the ventilation unit is disposed in the door and/or in the housing such that a first end of the conduit opens out into the interior volume and a second end of the conduit opens out into a work environment.

7. The freezer chamber as in claim 5, wherein the heating element is activatable by opening the door.

8. The freezer chamber as in claim 5, wherein the heating element is deactivatable after a passage of a specific time interval after the door is closed.

9. A method for operating a ventilation unit, comprising:
providing a freezer with a housing having an interior volume, a door, and the ventilation unit, wherein the ventilation unit comprises:
a conduit;
a heating element;
an air-permeable filler material disposed in at least sections of the conduit;
wherein the conduit comprises a filler material securement element; and
wherein the securement element is a tongue, the tongue has a contour cut out from a wall of the conduit, and the tongue is bent at a non-cut-out section into a cross section of the conduit;
detecting the door being opened;
activating the heating element based on detecting the door being opened;
detecting the door being closed;
deactivating the heating element based on a passage of a specific time interval after the door is closed.

10. The method for operating a ventilation unit as in claim 9, further comprising determining the specific time interval based on a temperature difference and/or a pressure differential between the interior volume and the work environment.

11. The method for operating a ventilation until as in claim 9, further comprising determining the specific time interval based on an interval of elapsed time since a last deactivation of the heating element and/or a last heating duration between a last activation and deactivation of the heating element.

* * * * *